US008893439B2

(12) United States Patent
Fujiwara et al.

(10) Patent No.: US 8,893,439 B2
(45) Date of Patent: Nov. 25, 2014

(54) BUILDING

(71) Applicant: Takenaka Corporation, Osaka-shi, Osaka (JP)

(72) Inventors: Hideki Fujiwara, Itasca, IL (US); Osamu Nakagome, Itasca, IL (US)

(73) Assignee: Takenaka Corporation, Osaka (JP)

( * ) Notice: Subject to any disclaimer, the term of this patent is extended or adjusted under 35 U.S.C. 154(b) by 151 days.

(21) Appl. No.: 13/779,747

(22) Filed: Feb. 28, 2013

(65) Prior Publication Data

US 2014/0238707 A1 Aug. 28, 2014

(51) Int. Cl.

| | |
|---|---|
| ***E04H 9/00*** | (2006.01) |
| ***A62C 2/06*** | (2006.01) |
| ***E04B 1/94*** | (2006.01) |
| ***E04F 11/02*** | (2006.01) |

(52) U.S. Cl.

CPC ... *A62C 2/06* (2013.01); *E04B 1/94* (2013.01); *E04F 11/02* (2013.01)

USPC ..... 52/1; 52/64; 52/185; 52/317

(58) Field of Classification Search

CPC ..... E04B 1/94; E04B 1/941; E04B 1/946; E04B 1/947; A62C 2/22; A62C 2/10; E04F 11/02; E04F 11/06; E04F 11/062

USPC ..... 52/1, 64, 184, 185, 317, 29, 174, 238.1; 160/133, 122, 6, 7, 9

See application file for complete search history.

(56) References Cited

U.S. PATENT DOCUMENTS

| | | | | |
|---|---|---|---|---|
| 1,785,487 | A * | 12/1930 | McAvoy | 49/70 |
| 3,591,221 | A * | 7/1971 | Alley | 160/1 |
| 4,606,431 | A * | 8/1986 | Ruder, Sr. | 182/49 |
| 5,022,197 | A * | 6/1991 | Aragona | 52/29 |
| 5,761,750 | A * | 6/1998 | Mazzola et al. | 4/500 |
| 6,763,911 | B2 * | 7/2004 | Burch | 182/49 |
| 6,957,716 | B1 * | 10/2005 | Norris | 182/48 |
| 8,332,981 | B2 * | 12/2012 | Woo et al. | 14/69.5 |
| 8,757,238 | B2 * | 6/2014 | Goodman et al. | 160/188 |
| 2005/0067116 | A1 * | 3/2005 | Ceccofiglio | 160/133 |
| 2011/0173904 | A1 * | 7/2011 | Manson et al. | 52/184 |

FOREIGN PATENT DOCUMENTS

| | | | |
|---|---|---|---|
| JP | 2004-218358 | A | 8/2004 |
| JP | 2005-042352 | A | 2/2005 |
| JP | 2011-084954 | A | 4/2011 |

* cited by examiner

*Primary Examiner* — Robert Canfield
*Assistant Examiner* — Matthew Gitlin
(74) *Attorney, Agent, or Firm* — SOLARIS Intellectual Property Group, PLLC

(57) ABSTRACT

A building is provided with a shutter, a stairway, and a handrail. The handrail has a connection member and a connection apparatus. The shutter opens and closes in a horizontal direction. A gap through which the shutter can pass is formed in the stairway. The handrail is provided at the stairway, and includes a handrail main body and a movable member. A gap through which the shutter can pass is formed in the handrail main body, and the movable member closes the gap in the handrail main body. The connection member connects one end portion of the movable member with the handrail main body such that the movable body is turnable relative to the handrail main body. The connection apparatus releasably connects another end portion of the movable member with the handle main body.

4 Claims, 14 Drawing Sheets

BUILDING

BACKGROUND

1. Technical Field

The present invention relates to a building.

2. Related Art

To prevent people from falling, handrails are provided at stairs of buildings. Various technologies are known that relate to handrail connection structures.

For example, Japanese Patent Application Laid-Open (JP-A) No. 2005-42352 discloses a technology relating to a handrail connection structure in which end faces of handrails provided inside a building are joined to one another. In this related art, the respective end faces of the handrails are inserted into a flexible contracting connector from both ends thereof, and the handrails are connected to one another using contracting force of the connector. Thus, a continuous handrail is formed.

JP-A No. 2004-218358 discloses a technology relating to a structure that connects end portions of handrail members to one another. In this related art, a male threaded portion is provided protruding from a central portion of a ring holding member, and a peripheral edge of a protrusion face where the male threaded portion is provided serves as a ring abutting portion. The ring holding portion is fixed by countersunk screws to an end face of a first handrail member so as to oppose a second handrail member. A female thread, into which the male threaded portion is threaded, is cut into a connecting ring body, which is provided with an inner collar portion. The connecting ring body is loosely fitted, to be turnable, into an end portion of the second handrail member. This connecting ring body is locked at the end face of the second handrail member by a lock member fixed to the end face of the second handrail member and whose outer diameter is a little larger than the outer diameter of the connecting ring body.

For reasons such as crime prevention and fire protection, shutters are provided in some buildings.

For example, JP-A No. 2011-84954 discloses a technology in which an operating device for usual opening and closing operations is structured using a wireless-type remote operating device and a reception section that receives signals from the remote operation device and inputs the signals to a control section of opening/closing machinery. Both the reception section and an emergency closing switch are provided at a single operation unit. This operation unit is provided at guide rails that guide movements of each of left and right side portions of a shutter curtain.

SUMMARY

When a shutter that opens and closes in a vertical direction is provided in a vicinity of stairs in a building, members associated with the shutter, such as shutter rails, are often obvious and detract from design appearance.

If, in consideration of design appearance, a shutter is provided to open and close in a horizontal direction, so as to laterally divide the stairs, the shutter may get caught on a handrail which is continuous as an important feature of handrails.

A building according to a first aspect of the present invention includes: a shutter that opens and closes in a horizontal direction; a stairway in which a gap through which the shutter can pass is formed; and a handrail disposed at the stairway. The handrail includes a handrail main body, in which a gap through which the shutter can pass is formed, and a movable member that closes the gap in the handrail main body, a connection member that connects one end portion of the movable member with the handrail main body, the movable body being turnable relative to the handrail main body, and a connection apparatus that releasably connects another end portion of the movable member with the handle main body.

In the building according to the first aspect, in a state in which the shutter is not closed (an opened state), the gap in the handrail body is filled by the movable member. Thus, the function of a handrail, which is required to be continuous, is provided.

When the shutter is being closed, the connection of the other end portion of the movable member with the handrail main body by the connection apparatus is released, the one end portion of the movable member turns relative to the handrail main body, and the gap in the handrail main body is opened. Hence, the shutter passes through the gap in the stairway and the gap in the handrail, and closes.

Because the gap in the handrail which is required to be continuous can be opened, the shutter may open and close in the horizontal direction. That is, a shutter that opens and closes in a horizontal direction so as to laterally divide a stairway may be provided.

In a building according to a second aspect of the present invention, the shutter includes at least one of a fire protection function or a smoke protection function and, in the event that a fire is detected, the shutter automatically closes and the connection of the other end portion of the movable member with the handrail main body by the connection apparatus is automatically released.

In the building according to the second aspect, in the event that a fire is detected, the connection between the other end portion of the movable member of the handrail and the handrail main body is automatically released, and the shutter that features at least one of a fire protection function or a smoke protection function closes and partitions the stairway in an up-and-down direction. Therefore, incursions of one or both of flames and smoke in the up-and-down direction of the stairway are prevented or suppressed.

In a building according to a third aspect or a fourth aspect of the present invention, the stairway is disposed in a shaft space, and the shaft space is partitioned into upper and lower portions by the shutter being closed.

In the building according to the third aspect or the fourth aspect, the shaft space is partitioned in the up-and-down direction by the shutter. Hence, flows of air and/or incursions of one or both of flames and smoke in the up-and-down direction of the shaft space are suppressed or prevented. Moreover, because movement using the stairs is no longer possible, there is a crime prevention effect.

DETAILED DESCRIPTION

Figure 1:
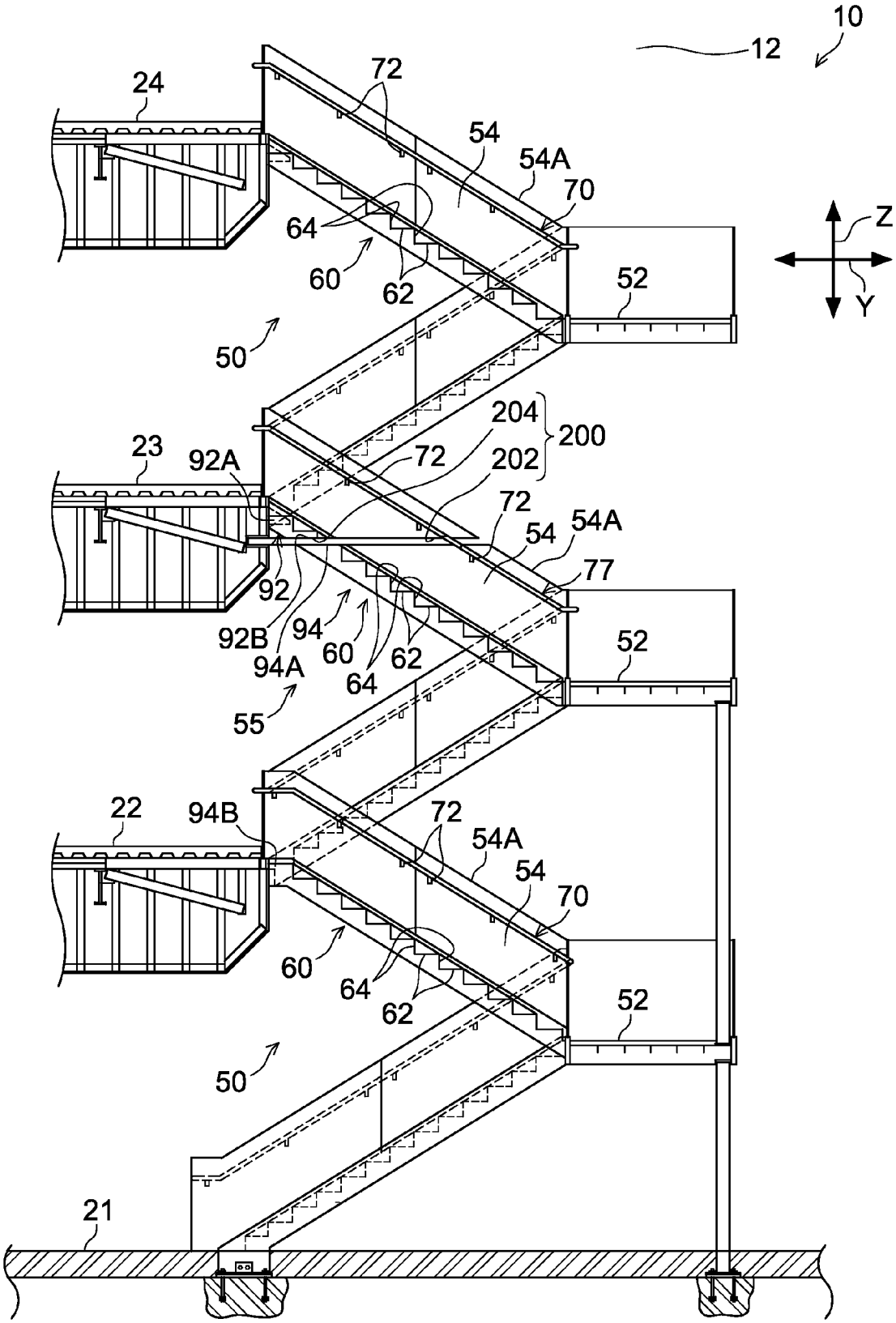
FIG. 1 is an elevation diagram of a shaft space of a building in accordance with an exemplary embodiment of the present invention.

Herebelow, a building in accordance with an exemplary embodiment of the present invention is described while referring to the drawings. In the drawings, two orthogonal directions in the horizontal direction are represented as an X direction and a Y direction, and the vertical direction is represented as a Z direction. To avoid complexity in sectional diagrams, diagonal lines (hatch) representing sectioned surfaces are not shown in some of the diagrams (i.e., the diagonal lines representing sectioned surfaces may be omitted from the drawings).

—Overall Structure of the Building—

First, the overall structure of a building 10 is described.

As shown in FIG. 1, the building 10 has four storeys, and a shaft space (a stairwell) 12 is formed extending in the vertical direction (the Z direction). The reference numerals 21, 22, 23 and 24 indicate floor boards (floor slabs) of the respective storeys.

Figure 2:
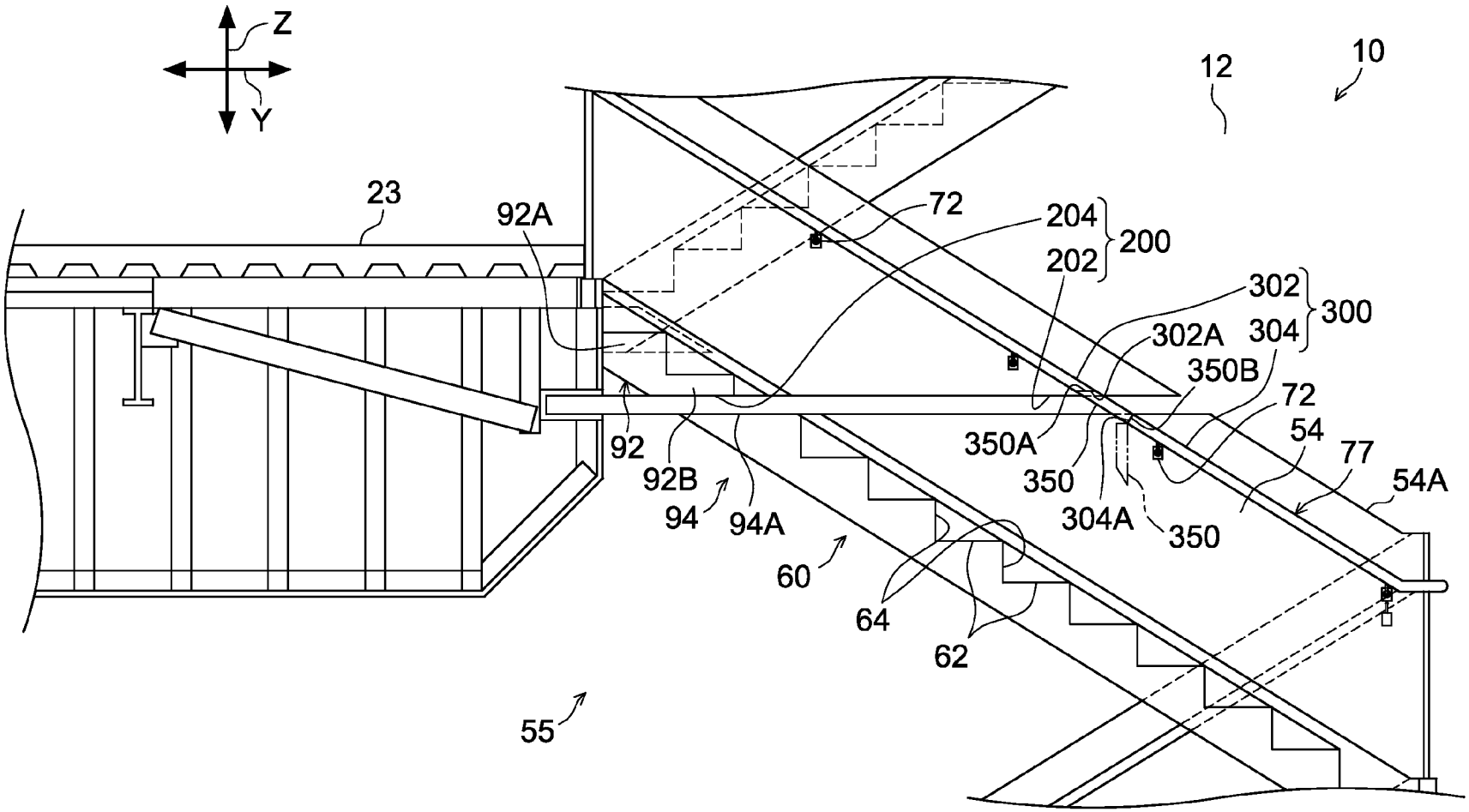
FIG. 2 is an elevation diagram in which a region of stairs between a second storey and a third storey in FIG. 1 is magnified.
Figure 3:
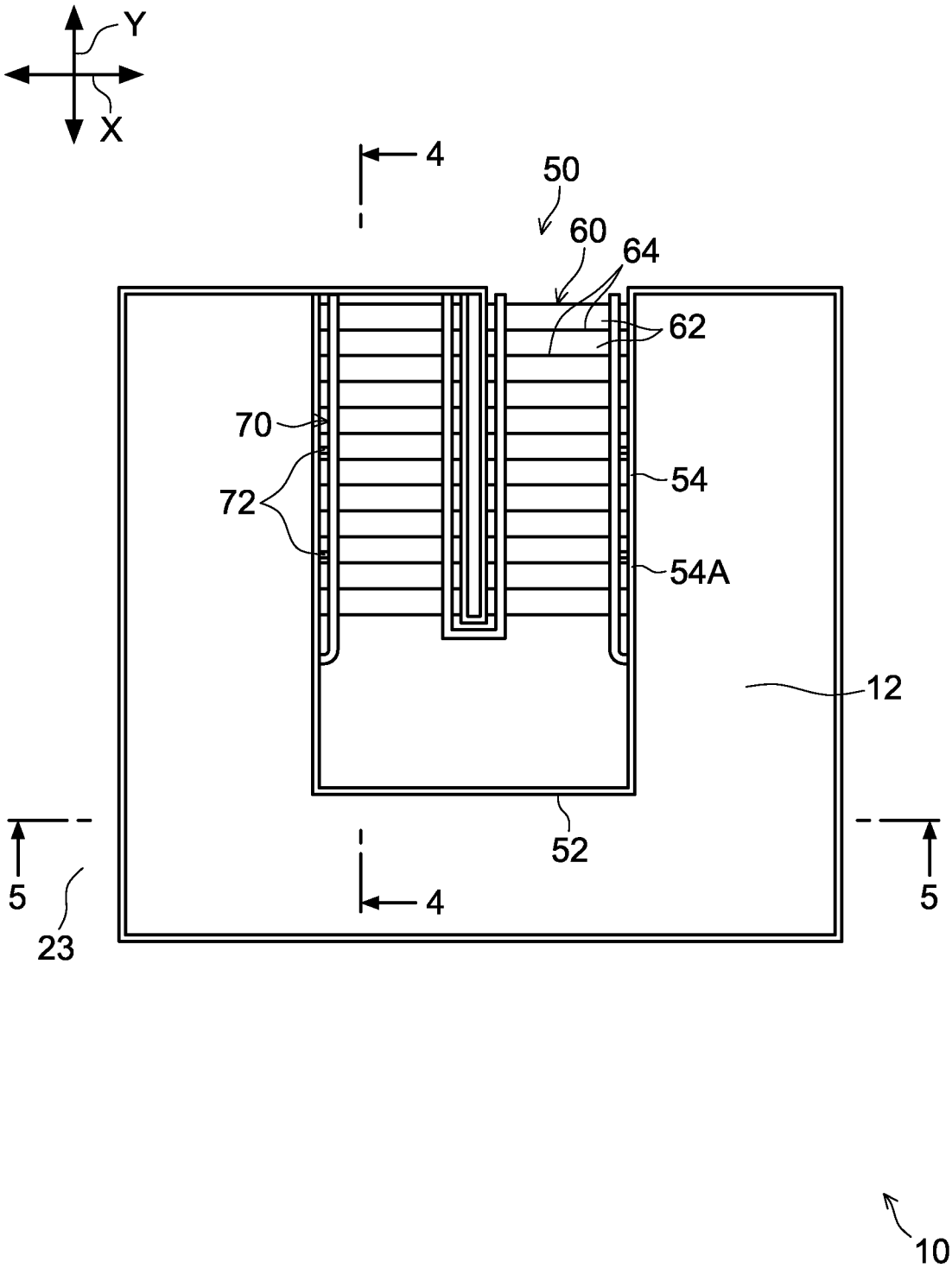
FIG. 3 is a plan view of principal portions of the shaft space shown in FIG. 1.

As shown in FIG. 1 and FIG. 3, stairways 50 and 55 linking the respective storeys are provided in the shaft space 12. The stairway 55 links the second storey (the floor board 22) with the third storey (the floor board 23) (see FIG. 2). As described below, a gap 200 is formed in the stairway 55 (and a gap 208 in a handrail 77) (see FIG. 2). The gap 200 is not formed in the other stairways. Each stairway 50 and stairway 55 have basic structures that are substantially the same apart from the presence/absence of the gap 200 (and the gap 208). Therefore, when the overall structure of the building 10 is being described, the stairway 50 and the stairway 55 are not distinguished.

Separately from the stairways 50 and 55 provided in the shaft space 12, the building 10 is also provided with emergency stairways which are not shown in the drawings.

Figure 6:
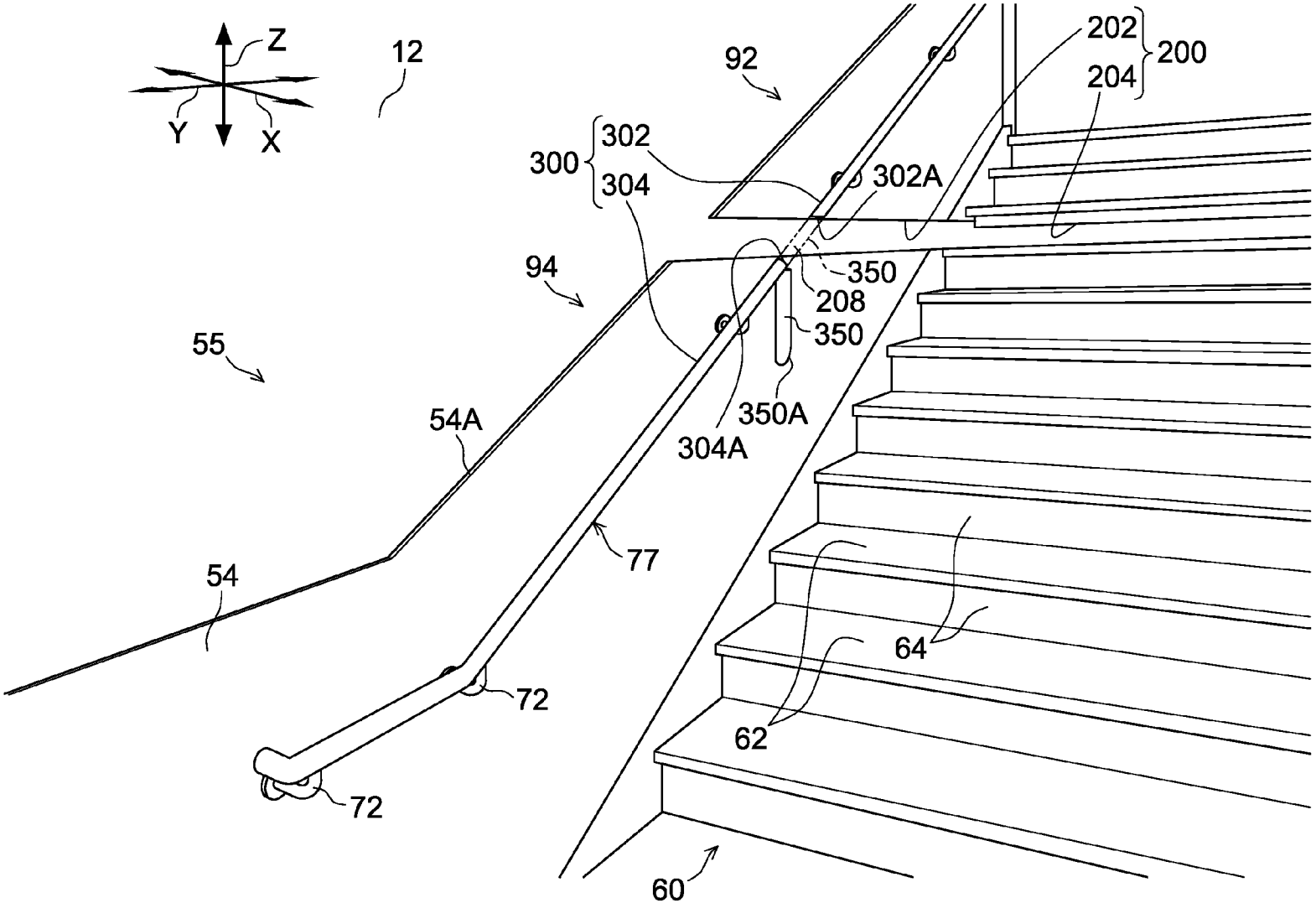
FIG. 6 is a perspective view of a stairway linking the second storey with the third storey in a state in which a gap in a handrail is opened.

As shown in FIG. 1, FIG. 3, FIG. 6, etc., each of these stairways 50 and 55 is a U-turn stairway that includes a landing 52 partway up and turns back 180° at the landing 52.

Each of the stairways 50 and 55 includes a stairway main body 60 and a side wall portion 54. The stairway main body 60 includes tread portions 62 and riser portions 64 that rise upward from end portions of the tread portions 62.

The side wall portion 54 rises up from a lateral direction end portion of the stairway main body 60. An upper end portion 54A of the side wall portion 54 is set to be parallel with a gradient angle of the stairway main body 60. A handrail 70 or 77 is attached to the side wall portion 54. The handrail 70 or 77 is attached to the side wall portion 54 by attachment members 72 that are spaced apart in a longitudinal direction of the handrail.

—Shutter Device—

Now, a shutter device 100 provided in the building 10 is described. The shutter device 100 has both a fire protection function and a smoke protection function (i.e., a fireproof and smokeproof shutter).

Figure 5:
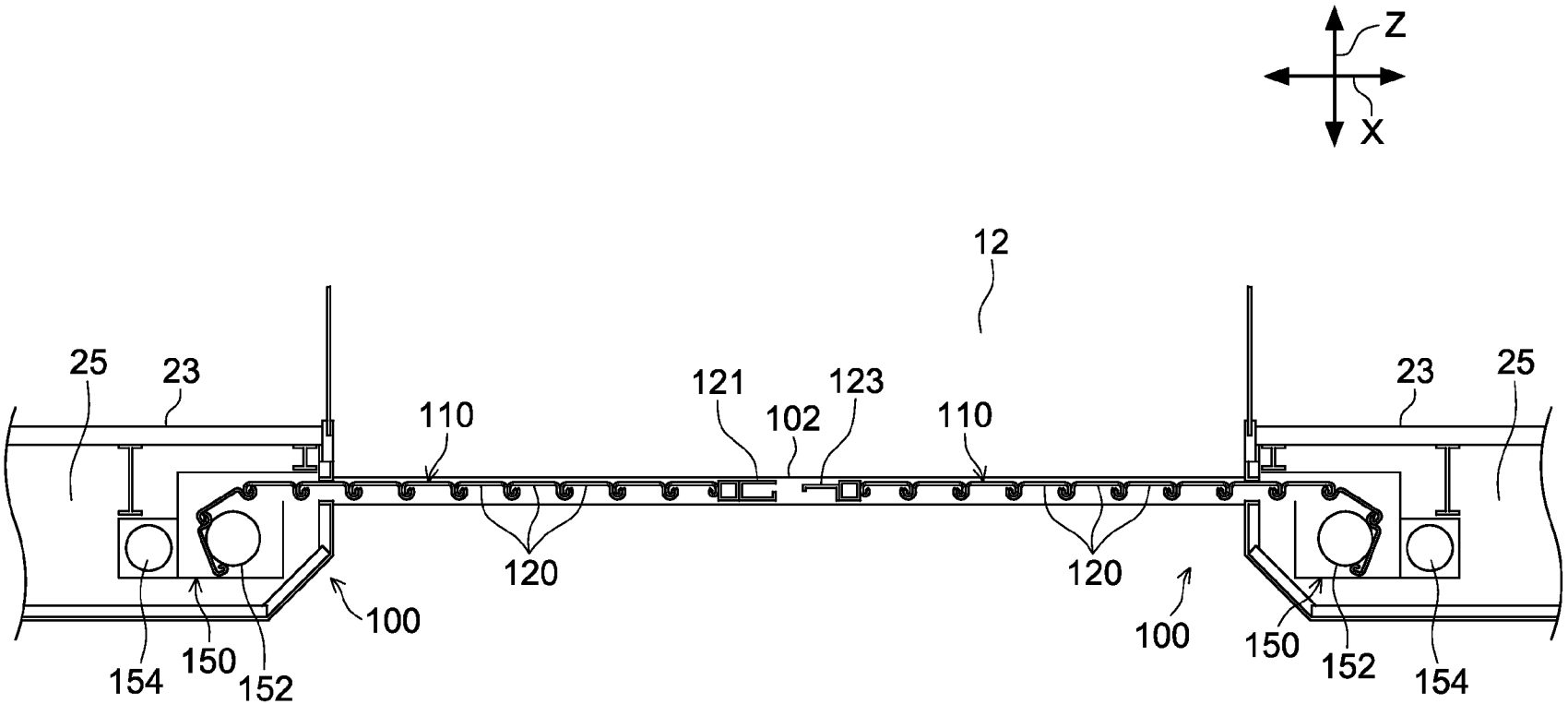
FIG. 5 is a vertical sectional diagram, taken along line 5-5 in FIG. 3, showing the shutter device.

As shown in FIG. 5, the shutter device 100 is provided in a stairway space 25 at the underside of the floor board 23. The shutter device 100 is a roller-type shutter that extends and retracts in a horizontal direction. The shutter device 100 is respectively provided at both sides in the X direction, sandwiching the shaft space 12. The extending and retracting directions of shutters 110, which are described below, of these two shutter devices 100 are in opposite directions. Otherwise, the two shutter devices 100 have the same structures apart from distal end portions thereof. Therefore, apart from the distal end portions, the two shutter devices 100 are not distinguished in the descriptions.

Figure 4:
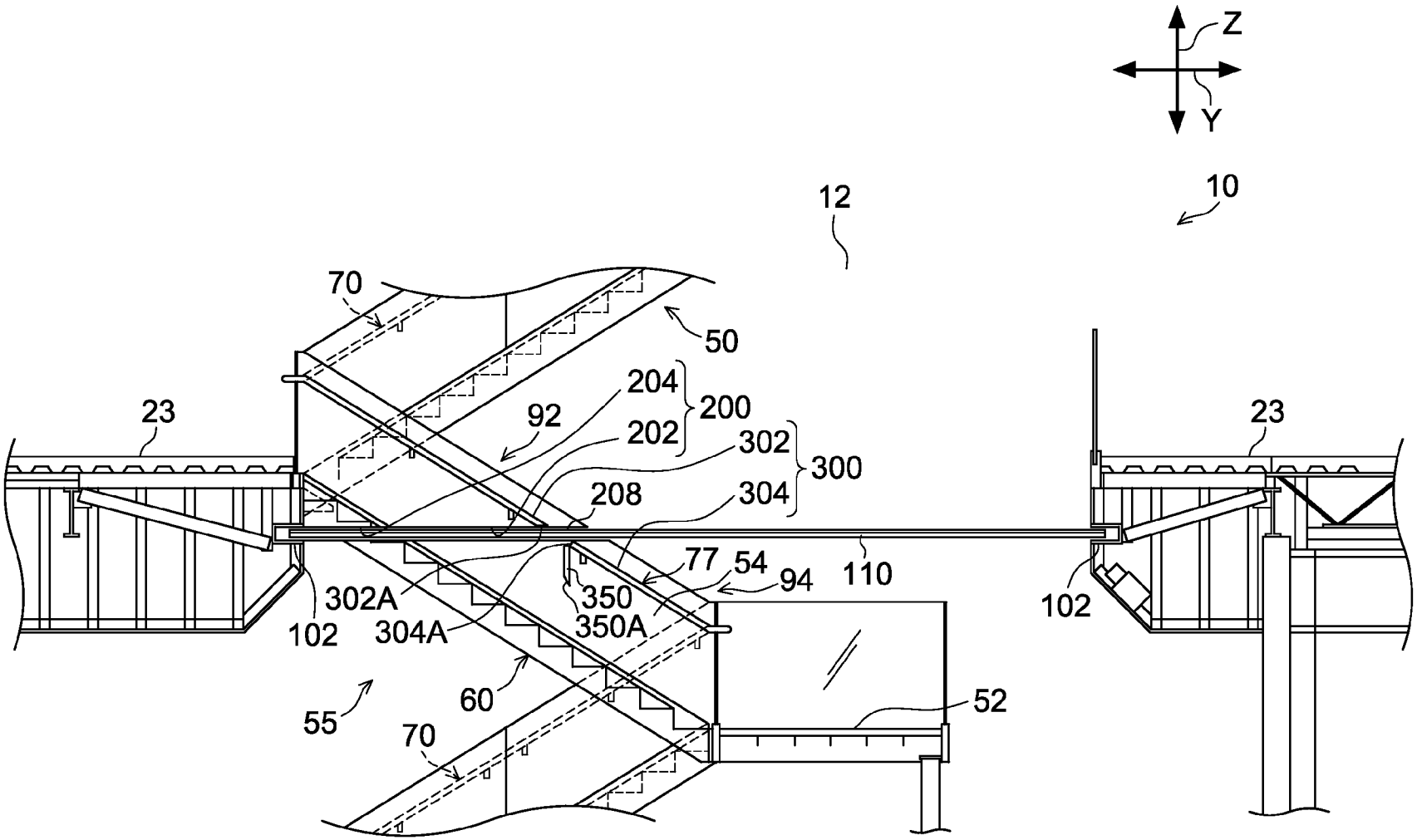
FIG. 4 is a vertical sectional diagram, taken along line 4-4 in FIG. 3, showing a shutter device.

Each shutter device 100 is structured with a winding device section 150, the shutter 110, and shutter rails 102 (see FIG. 4).

Each shutter rail 102 is provided along the X direction at a wall face of the shaft space 12. The shutter rail 102 has a groove shape, into which a width direction (Y direction) end portion of each shutter 110 is inserted. Hence, the shutters 110 can be moved in the X direction along the shutter rails 102.

Each shutter 110 is structured by a plural number of slats 120, which are disposed with length directions thereof in the Y direction and which are arranged alongside one another in the X direction. Long sides of the slats 120 are curved into pipe shapes and engaged with one another. Thus, the slats 120 are turnably joined. The material of the slats 120 is not particularly limited provided a fire protection function is assured such that the shutter 110 functions as a fireproof shutter.

A distal end member 121 is provided at a distal end portion of one of the shutters 110 (the left side shutter 110 in the drawings). The distal end member 121 has a laterally opening letter U shape in a cross section, and is disposed with an opening side thereof at a distal end side of the shutter 110. A plate-shaped distal end member 123 is provided at a distal end portion of the other shutter 110 (the right side shutter 110 in the drawings).

Each winding device section 150 is structured with a drum-shaped winding portion 152 and a driving section 154. The drum-shaped winding portion 152 takes up the shutter 110 and is configured to be turned by the driving section 154.

When the drum-shaped winding portion 152 of the winding device section 150 turns in the direction opposite to the take-up direction, the shutter 110 is pushed out along the shutter rails 102. When the shutters 110 are pushed out from both sides in the X direction, the shutters 110 close and the shaft space 12 is partitioned into upper and lower potions, between the second storey (the floor board 22) and the third storey (the floor board 23), by the shutters 110.

When the left and right shutters 110 are closed, the distal end member 123 of the other shutter 110 (the right side shutter 110 in the drawings) is inserted into the distal end member 121 with the laterally opening letter U shape in cross section of the one shutter 110 (the left side shutter 110 in the drawings). The distal end member 121 of the one shutter 110 is superposed in the up-and-down direction with the distal end member 123 of the other shutter 110. Thus, a structure is formed that prevents or suppresses incursions of flames and smoke in the up-and-down direction.

The shutter devices 100 are equipped with a hazard prevention device, which is not shown in the drawings, that prevents a person being trapped between the shutters 110 even if the shutters 110 are closed automatically.

—Structure of the Stairs Linking the Second Storey with the Third Storey—

Now, the structure of the stairway 55 linking the second storey with the third storey is described.

As shown in FIG. 1 and FIG. 2, the gap 200 for the shutters 110 of the shutter devices 100 to pass along (see FIG. 5) is formed in the stairway 55 linking the second storey (the floor board 22) with the third storey (the floor board 23). Specifically, a gap 204 is formed in the stairway main body 60 of the stairway 55, and a gap 202 is formed in the side wall portion 54.

Described from another perspective, the stairway 55 linking the second storey with the third storey is a structure that is divided into an upper side stairway 92 and a lower side stairway 94. The upper side stairway 92 is a cantilever structure of which an upper end portion 92A is joined to the floor board 23 of the third storey and a lower end portion 92B is a free end. Correspondingly, the lower side stairway 94 is a cantilever structure of which a lower end portion 94B is joined to the floor board 22 of the second storey as shown in FIG. 1 and an upper end portion 94A is a free end as shown in FIG. 1 and FIG. 2.

As shown in FIG. 2 and FIG. 6, the handrail 77 of the stairway 55 linking the second storey with the third storey includes a handrail main body 300 and a movable member 350. The gap 208 through which the shutter(s) 110 of the shutter devices 100 (see FIG. 5) pass is formed in the handrail main body 300. The movable member 350 closes off the gap 208 of the handrail main body 300.

As shown in FIG. 2, FIG. 6, FIG. 7 and FIG. 8, when the handrail main body 300 and the movable member 350 are connected, the gap 208 is closed (filled) and the handrail main body 300 and movable member 350 are made integral.

The handrail main body 300 at an upper side of the gap 208 is an upper side main body 302, and a lower end portion of the upper side main body 302 is an upper side main body end portion 302A. The handrail main body 300 at a lower side of the gap 208 is a lower side main body 304, and an upper end portion of the lower side main body 304 is a lower side main body end portion 304A.

In side view, an end face of an upper end portion 350A of the movable member 350 is horizontal, and an end face of the upper side main body end portion 302A of the handrail main body 300 opposing the end face of the upper end portion 350A is also horizontal.

Figure 7:
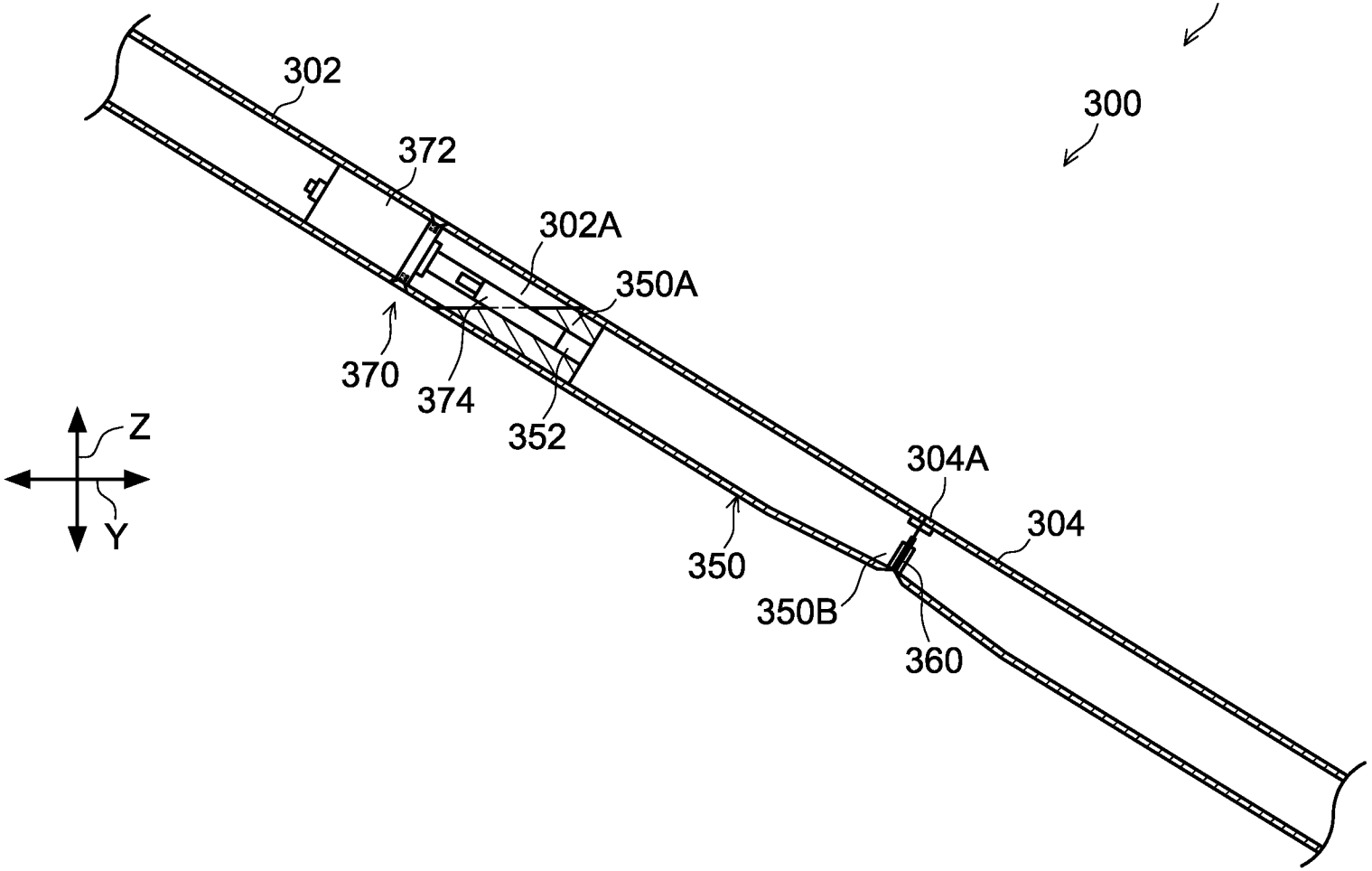
FIG. 7 is a vertical sectional diagram of the handrail in a state in which the gap is closed by a movable member.
Figure 8:
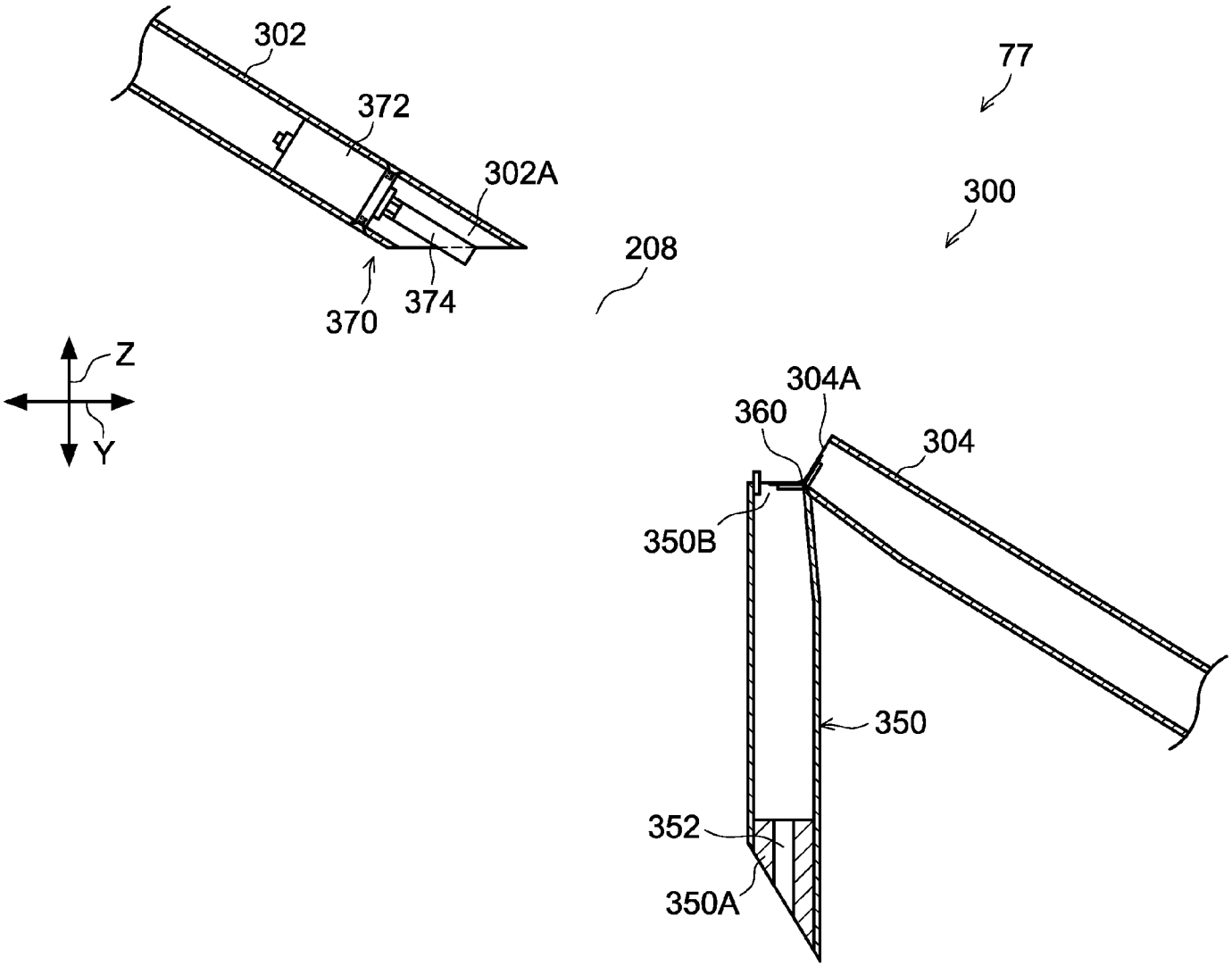
FIG. 8 is a vertical sectional diagram of the handrail in a state in which a connection of the movable member is released and the gap is opened.

As shown in FIG. 7 and FIG. 8, a lower end portion 350B of the movable member 350 is connected to the lower side main body end portion 304A of the handrail main body 300 by a hinge 360, which is an example of a connection member. Thus, the movable member 350 is connected to the lower side main body end portion 304A of the handrail main body 300 to be turnable, about a turning axis in the X direction, relative to the lower side main body 304 of the handrail main body 300.

The upper end portion 350A of the movable member 350 is connected to the upper side main body end portion 302A of the upper side main body 302 of the handrail main body 300 by a connection apparatus 370.

The connection apparatus 370 includes a solenoid 372 provided in the upper side main body end portion 302A of the handrail main body 300 and a cylinder portion 352 provided in the upper end portion 350A of the movable member 350. The solenoid 372 extends and retracts a movable pin 374. The movable pin 374 can be inserted into the cylinder portion 352.

As shown in FIG. 7, in a state in which the movable pin 374 of the solenoid 372 is extended and protrudes, the movable pin 374 is inserted into the cylinder portion 352 of the movable member 350. Because the movable pin 374 is inserted into the cylinder portion 352, the turning of the movable member 350 is blocked, and the upper end portion 350A of the movable member 350 and the upper side main body end portion 302A of the handrail main body 300 are in a connected state. That is, this is the state in which the movable member 350 closes the gap 208 of the handrail main body 300.

In contrast, as shown in FIG. 8, in a state in which the movable pin 374 of the solenoid 372 is retracted and drawn in, the movable pin 374 is disengaged from the cylinder portion 352 of the movable member 350 and an upper end portion 350A side of the movable member 350 is turned to the lower side by gravity, producing a state in which the gap 208 of the handrail main body 300 is open (see FIG. 6).

The state in FIG. 7 in which the movable member 350 and the handrail main body 300 are connected may be formed again in the event that the movable member 350 is returned to the original position and the withdrawn movable pin 374 of the solenoid 372 is extended and inserted into the cylinder portion 352 of the movable member 350.

—Fire Protection System—

Now, a fire protection system of the building 10 is described.

Figure 9:
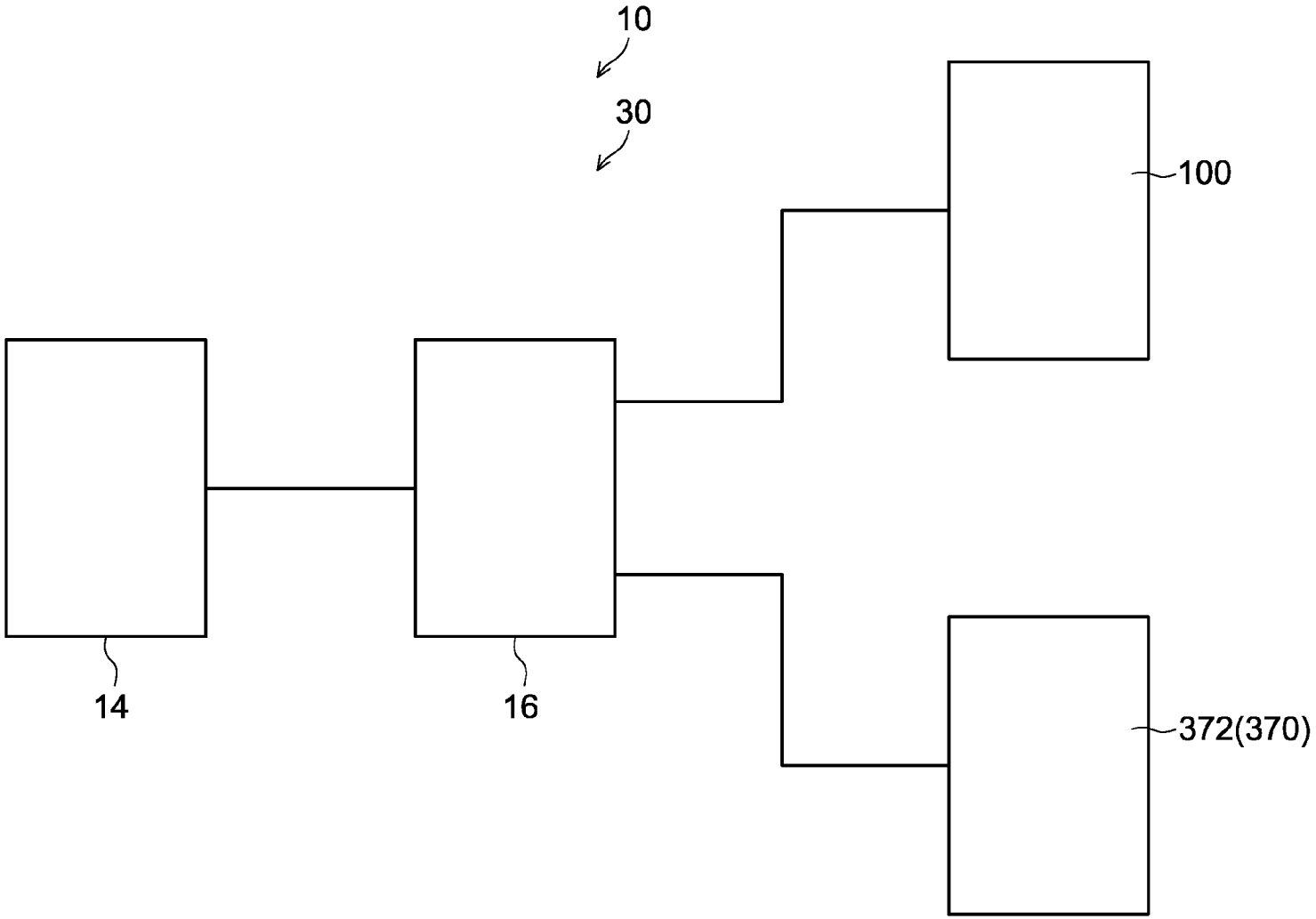
FIG. 9 is a block diagram of a fire protection system.

As shown in FIG. 9, a fire detection system 30 is provided in the building 10. The fire detection system 30 includes a smoke detector 14, a fire alarm 16, the shutter devices 100, and the connection apparatus 370 (the solenoid 372).

The smoke detector 14 is electronically connected with the fire alarm 16, and the fire alarm 16 is electronically connected with the shutter devices 100 (see FIG. 5) and the solenoid 372 of the connection apparatus 370 (see FIG. 7 and FIG. 8).

If a fire occurs in the building 10, smoke produced by the fire is detected by the smoke detector 14. When the smoke detector 14 detects the smoke produced by the fire, the fire alarm 16 operates and reports the occurrence of the fire with sound and lights or the like. When the fire alarm 16 operates, the shutter devices 100 and the solenoid 372 (the connection apparatus 370) operate correspondingly.

—Operation and Effects—

Now, operation and effects of the present exemplary embodiment are described.

As described above, if the smoke detector 14 shown in FIG. 9 detects smoke produced by a fire, the fire alarm 16 operates and reports the occurrence of the fire with sound and lights or the like. When the fire alarm 16 operates, the shutter devices 100 and the solenoid 372 (the connection apparatus 370) operate in conjunction therewith.

That is, as shown in FIG. 8, the movable pin 374 of the solenoid 372 of the connection apparatus 370 is retracted and drawn in, the movable pin 374 disengages from the cylinder portion 352 of the movable member 350, and the upper end portion 350A side of the movable member 350 is turned to the lower side by gravity. Thus, as illustrated in FIG. 6 and FIG. 8, the gap 208 is opened in the handrail 77.

As shown in FIG. 4 and FIG. 5, the shutter devices 100 operate and the shutters 110 are closed. At this time, the shutters 110 pass through the gap 200 in the stairway 55 (the gap 202 and the gap 204) and the gap 208 in the handrail 77.

Thus, if a fire occurs in the building 10, the connection between the upper end portion 350A of the movable member 350 and the upper side main body end portion 302A of the handrail main body 300 is automatically released, the shutters 110 with the fire protection function automatically close, and the shaft space 12 is partitioned in the up-and-down direction. Hence, because the shaft space 12 is partitioned in the up-and-down direction by the shutters 110, incursions of flames and smoke in the up-and-down direction of the shaft space 12 are prevented or suppressed.

In the state in which the shutters 110 are not closed (the opened state), the gap 208 of the handrail main body 300 is closed off (filled) by the movable member 350, as shown in FIG. 7, and the function of a handrail that is required to be continuous is provided.

On the other hand, as described above, when a fire occurs and the shutters 110 are being closed, the connection by the connection apparatus 370 between the upper end portion 350A of the movable member 350 and the lower side main body end portion 304A is released. Thus, the movable member 350 turns and the gap 208 is opened in the handrail main body 300. Hence, the shutters pass through the gap 200 of the stairway 55 and the gap 208 of the handrail 77, and close.

Because the gap 208 is opened thus in the handrail 77 that is required to be continuous, the shutters 110 that close in the horizontal direction so as to laterally divide the stairway 55 may be provided, and the shaft space 12 may be partitioned into upper and lower portions.

Note that, if shutters that open and close in the vertical direction were to be used, shutter-related members such as shutter rails and the like would be disposed at boundary regions between the stairways 50 and 55 and the floor boards (floor slabs) 21, 22, 23 and 24 of the respective storeys, which would detract from design appearance.

With a structure that opens and closes in the horizontal direction with the shutters 110 so as to laterally divide the stairway 55, as in the present exemplary embodiment, in contrast to a case in which shutters that open and close in the vertical direction are provided, there are no shutter-related members such as shutter rails and the like around the stairway, and an open atmosphere may be formed around the stairway, and design appearance may be improved, as a result.

Furthermore, if shutters that open and close in the vertical direction were to be used, respective shutters would be required at boundary regions between the stairways 50 and 55 and the floor boards (floor slabs) 21, 22, 23 and 24 of the respective storeys (four shutters would be required at each storey), so a total of twelve vertical shutters would be required. In contrast, with a structure that opens and closes in the horizontal direction with the shutters 110 so as to partition the shaft space 12 into upper and lower portions, as in the present exemplary embodiment, the number of shutters is reduced, as a result of which construction costs can be reduced.

—Variant Example—

In the exemplary embodiment described above, as shown in FIG. 7 and FIG. 8, the lower end portion 350B of the movable member 350 is connected with the lower side main body end portion 304A of the handrail main body 300 by the hinge 360, and the upper end portion 350A of the movable member 350 is connected with the upper side main body end portion 302A of the handrail main body 300 by the connection apparatus 370, but this is not limiting.

Figure 10:
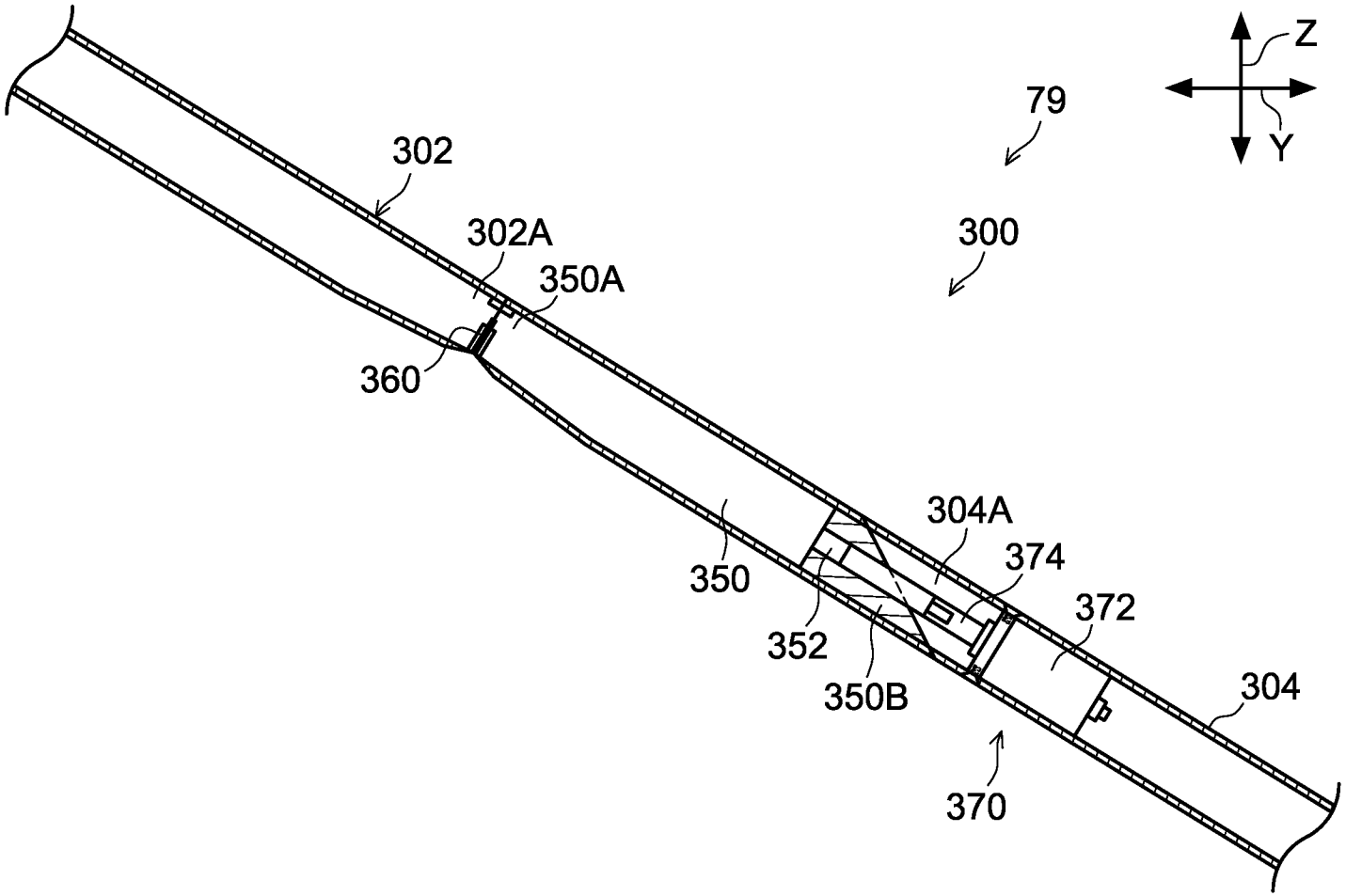
FIG. 10 is a vertical sectional diagram of a state in which a gap in a handrail in accordance with a variant example is closed by a movable member.
Figure 11:
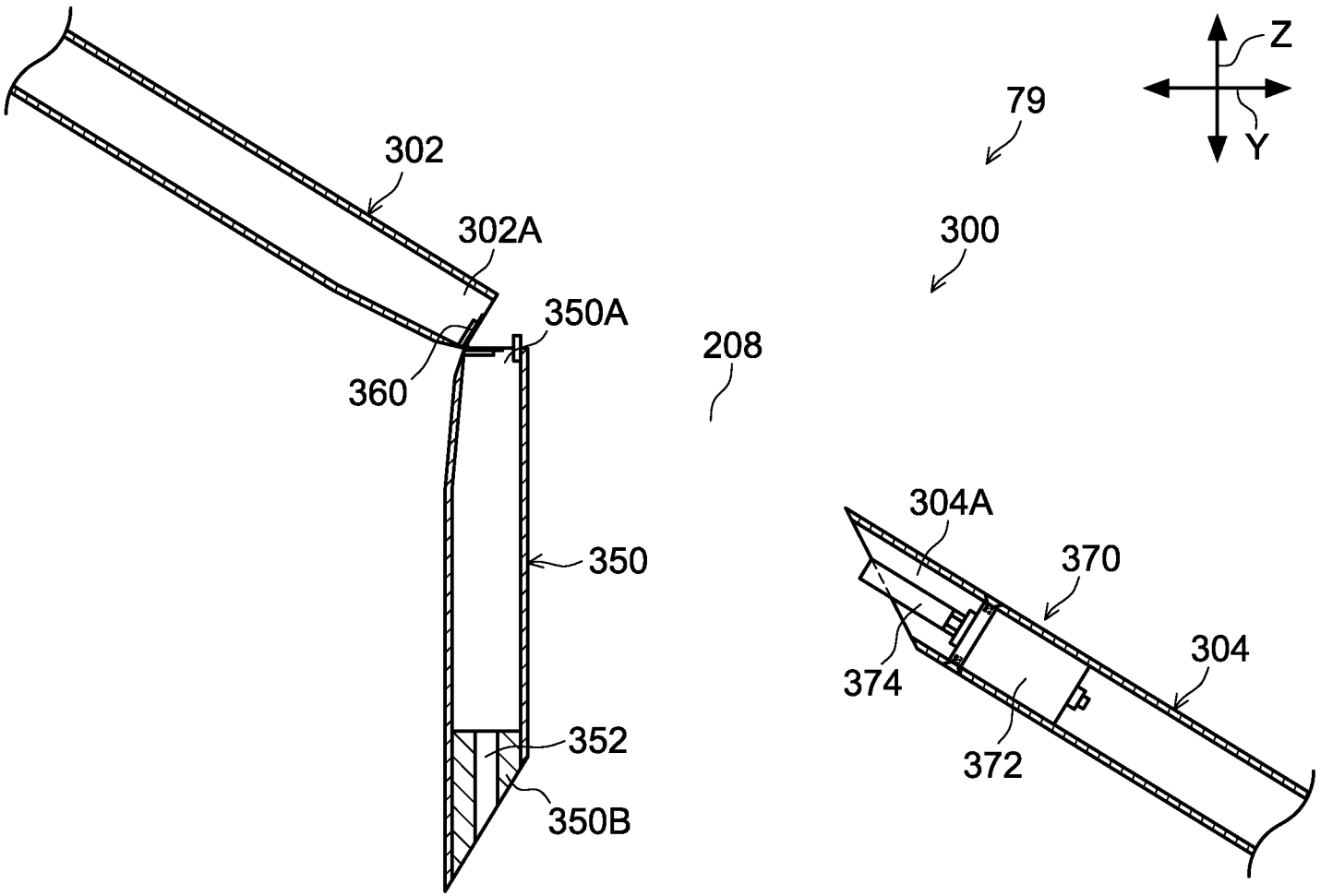
FIG. 11 is a vertical sectional diagram of a state in which the handrail of the variant example is open.
Figure 12:
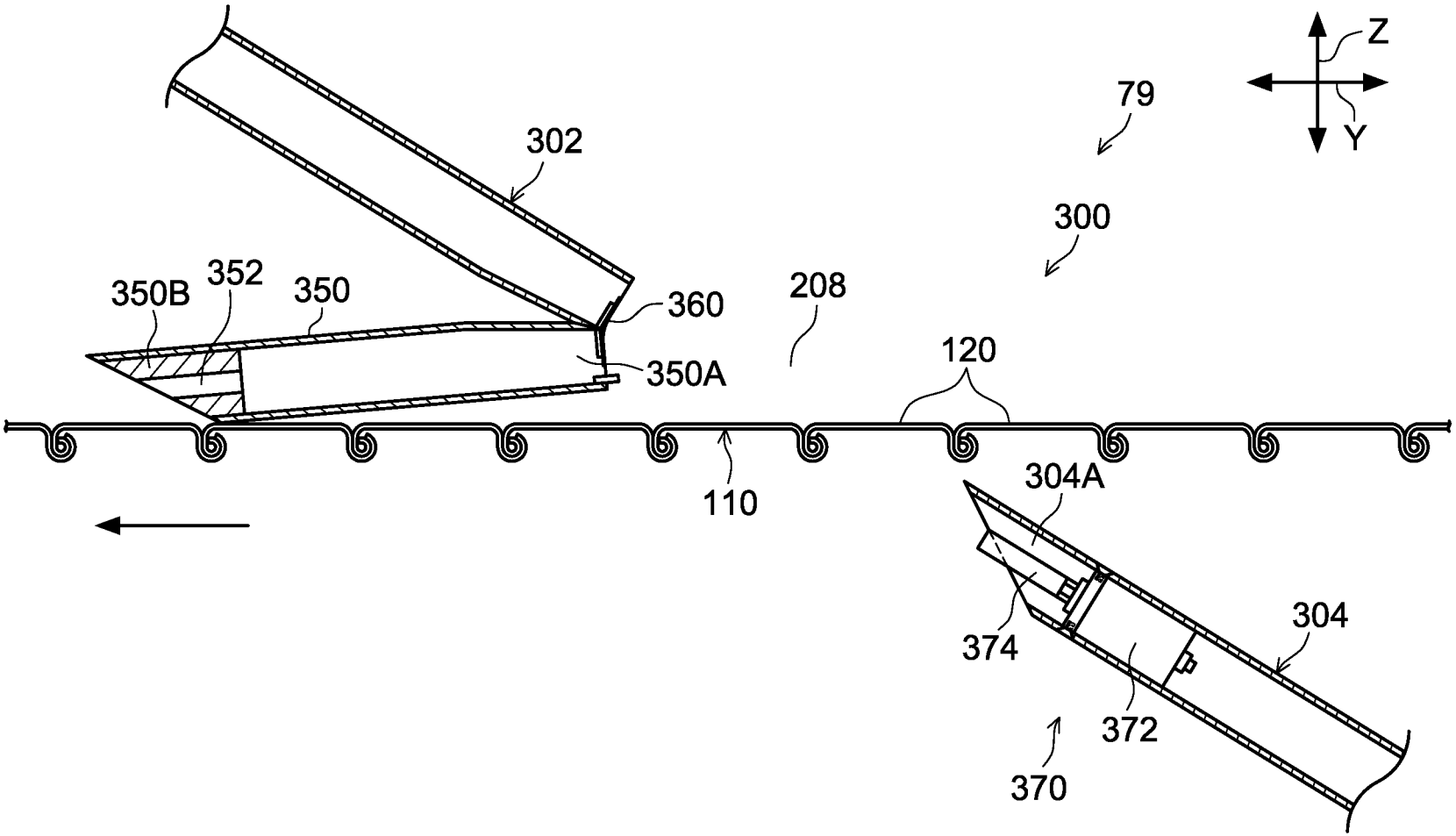
FIG. 12 is a vertical sectional diagram of a state in which a shutter has pushed up the movable member of the handrail of the variant example.

As at a handrail 79 of a variant example that is shown in FIG. 10 to FIG. 12, the lower end portion 350B of the movable member 350 may be connected with the lower side main body end portion 304A of the handrail main body 300 by the connection apparatus 370 and the upper end portion 350A of the movable member 350 may be connected with the upper side main body end portion 302A of the handrail main body 300 by the hinge 360.

In side view, the lower end portion 350B of the movable member 350 is vertical and the surface of the lower side main body end portion 304A of the handrail main body 300 that opposes the lower end portion 350B is also vertical.

In the case of the handrail 79 of this variant example, as shown in FIG. 11, in the state in which the movable pin 374 of the solenoid 372 is retracted and drawn in, the movable pin 374 disengages from the cylinder portion 352 of the movable member 350, the lower end portion 350B side of the movable member 350 is turned to the lower side by gravity, and the gap 208 is opened in the handrail 79.

Hence, as shown in FIG. 12, it is configured that the shutters 110 open and close in the Y direction, the movable member 350 is pushed up when the shutters 110 are closing. Thus, the shutter 110 passes through the gap 208 of the handrail main body 300.

A structure may be employed in which, when the movable pin 374 disengages from the cylinder portion 352 of the movable member 350 and the connection is released, the movable member 350 is automatically pushed up by a spring or the like into the state shown in FIG. 12.

As another variant example, which is not shown in the drawings, a structure is possible in which the turning axis of the movable member 350 is the vertical direction and the movable member 350 turns in a horizontal direction. In the case of this variant example, when the connection between the end portion of the movable member 350 and the handrail main body 300 is released, the movable member 350 may be automatically turned in the horizontal direction by a spring or the like.

Next, an example of a structure in a case in which there is a pillar 31 between the left and right shutters 110 is described.

Figure 13:
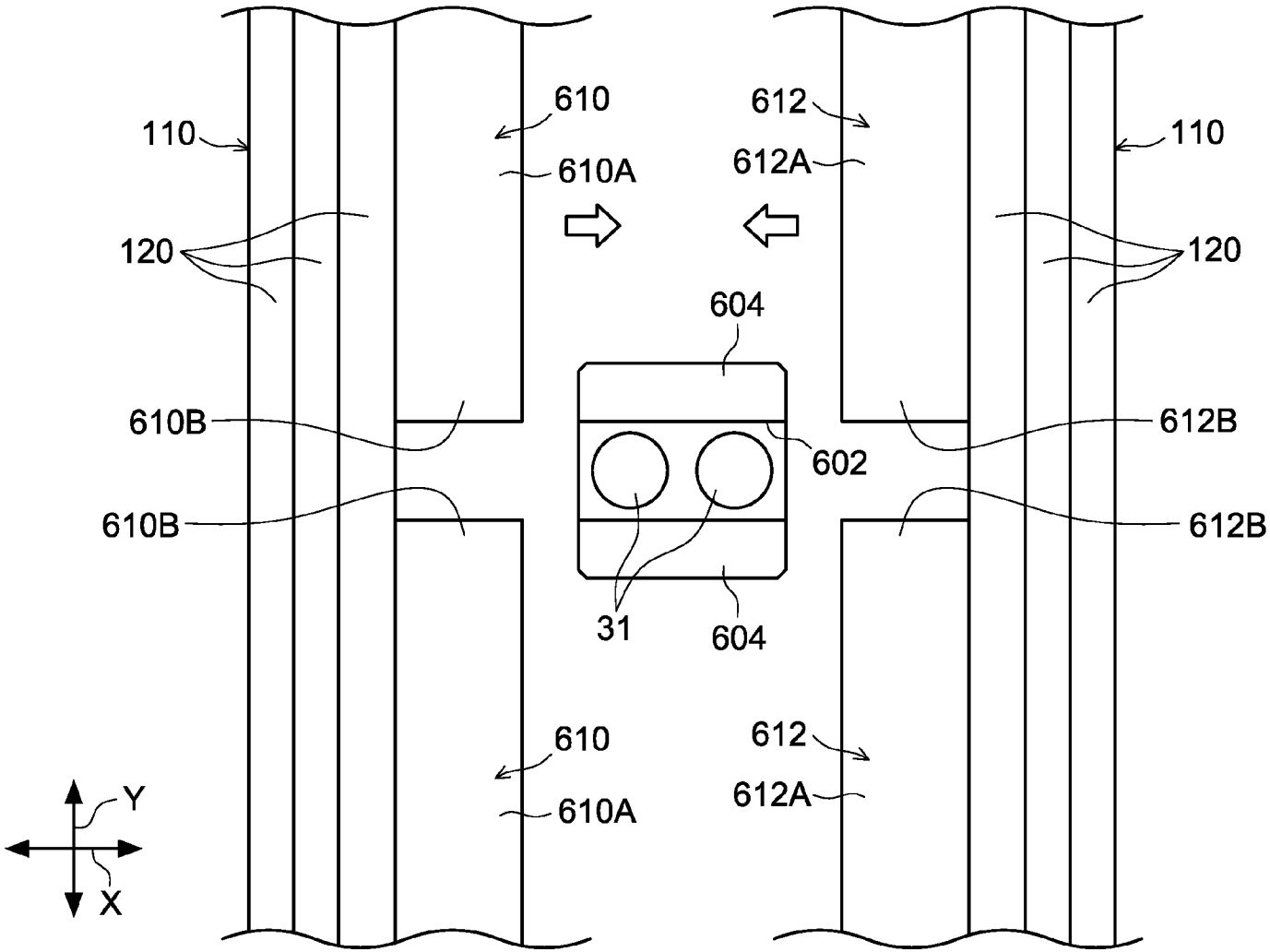
FIG. 13 is a plan view schematically showing an example of structures in a case in which there is a pillar between left and right shutters, showing a state before the shutters are closed.
Figure 14:
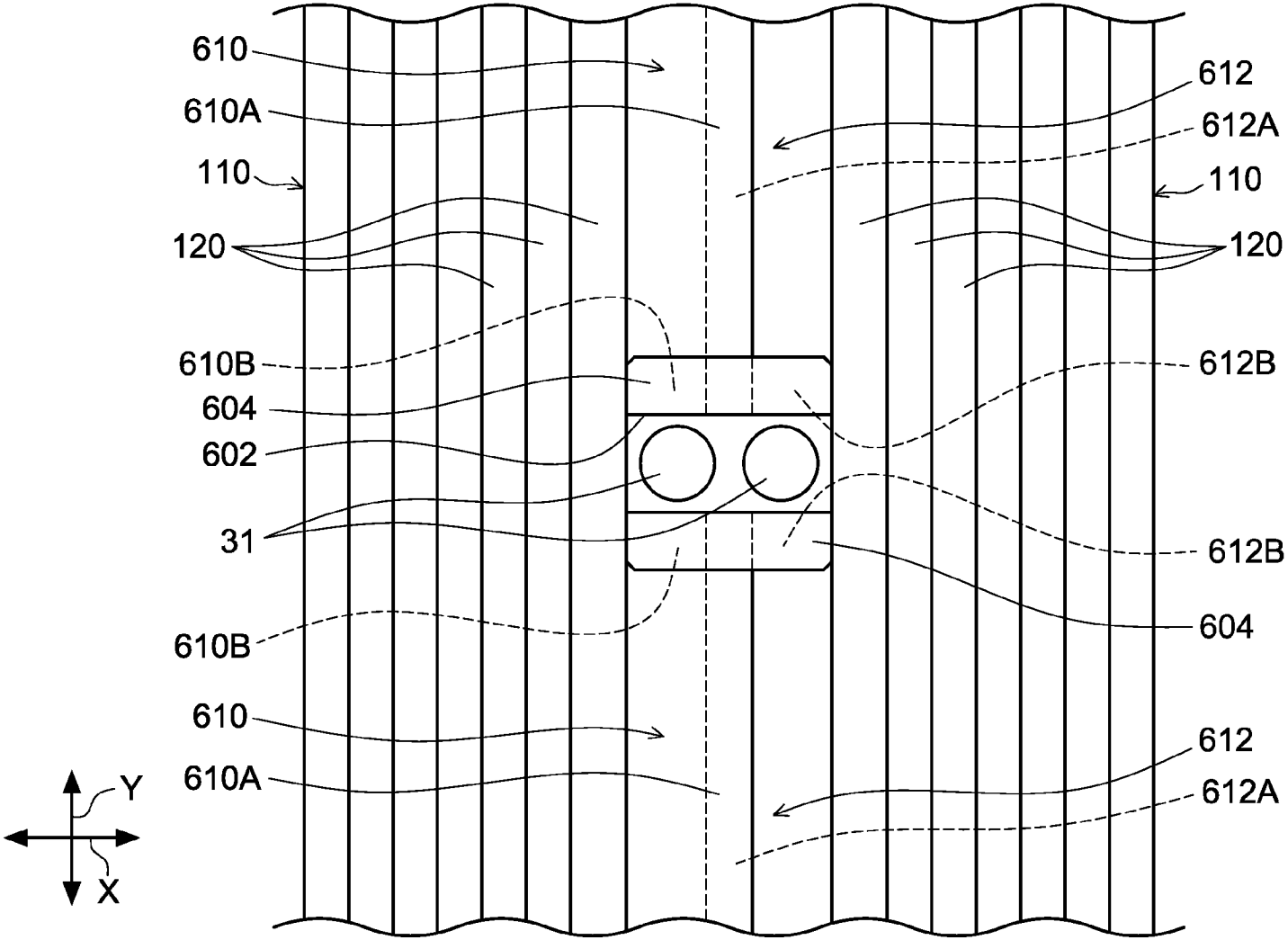
FIG. 14 is a plan view schematically showing a state in which the shutters in FIG. 13 are closed.

As shown in FIG. 13 and FIG. 14, the two pillars 31 are provided between the left and right shutters 110. A plate-shaped mounting member 602 through which the pillars 31 pass is fixed to the pillars 31 at a position corresponding with the shutters 110. Guide members 604 are mounted to both side portions in the Y direction of the mounting member 602. The guide members 604 have laterally opening letter U shapes in a cross section, and are disposed with the opening sides thereof at the Y direction outer sides.

Distal end members 610 are provided at a distal end portion of one of the shutters 110 (the left side shutter 110 in the drawings). Each distal end member 610 has a laterally opening letter U shape in a cross section, and is disposed with the opening side thereof positioned at a distal end side of the distal end member 610. The distal end members 610 are spaced apart in the Y direction. Plate-shaped distal end members 612 are provided at distal end portion of the other shutter 110 (the right side shutter 110 in the drawings). The distal end members 612 are spaced apart in the Y direction.

As shown in FIG. 14, when the left and right shutters 110 are closed, side portions 610B and 612B of the distal end members 610 and 612 enter into the guide members 604 with laterally opening letter U shapes in cross section. Meanwhile, end portions 612A of the distal end members 612 at the other shutter 110 enter into end portions 610A of the distal end members 610 with laterally opening letter U shapes in cross section of the one shutter 110.

That is, the side portions 610B and 612B of the distal end members 610 and 612 of the left and right shutters 110 are superposed in the up-and-down direction with the guide members 604, and the end portions 612A of the distal end members 612 of the other shutter 110 are superposed in the up-and-down direction with the end portions 610A of the distal end members 610 of the one shutter 110. Thus, a structure is formed that prevents or suppresses incursions of flames and smoke in the up-and-down direction.

—Other Modes—

The present invention is not limited by the exemplary embodiments described above.

For example, in the above exemplary embodiments, the movable member 350 is turnably connected to the handrail main body 300 by the hinge 360, but this is not limiting. For example, the movable member 350 may be turnably connected to the handrail main body 300 by a resin member with a small thickness featuring flexibility, such as an integral hinge. In other words, it is sufficient if the configuration is made such that the movable member 350 may be turnably connected to the handrail main body 300.

As another example, in the above exemplary embodiments, as shown in FIG. 9, the shutter devices 100 and the solenoid 372 (the connection apparatus 370) operate in conjunction with operation of the fire alarm 16, but this is not limiting.

For example, the solenoid 372 (the connection apparatus 370) may be electronically connected with the shutter devices 100 and the solenoid 372 (the connection apparatus 370) may operate in conjunction with operation of the shutters 110.

As a further example, in the above exemplary embodiments, the connection apparatus 370 that releasably connects the movable member 350 with the handrail main body 300 has a structure in which the connection is released by the movable pin 374 of the solenoid 372 being retracted, but this is not limiting. For example, a structure is possible in which the connection is made by a hook member provided at the handrail main body 300 hooking into a hole portion in the movable member 350 and the connection is released by the hook member turning and disengaging from the hole portion. In other words, it is sufficient for the device that the connection between the movable member 350 and the handrail main body 300 be releasable.

As a further example, in the above exemplary embodiments, a fire is detected by smoke detection using the smoke detector 14, but this is not limiting. For example, a fire may be detected by heat sensing using a heat sensor.

As a further example, in the above exemplary embodiments, the shutter devices 100 have both a fire protection function and a smoke protection function, and each shutter device 100 is a roller-type shutter in which the shutter 110 opens and closes in the horizontal direction, but this is not limiting.

The shutter device may have only one of the fire protection function and the smoke protection function, and prevent or suppress the incursion of only one of flames and smoke. Furthermore, a shutter device can also be employed that has neither the fire protection function nor the smoke protection function (or is not primarily intended to provide such functions): for example, a shutter device that is primarily intended for crime prevention or airflow control or the like. When the shaft space 12 is partitioned in the up-and-down direction, movements using the stairways 50 and 55 are not possible, so there is a crime prevention effect.

Shutter devices other than roller-type shutter devices that open and close in the horizontal direction are also applicable.

As a further example, in the above exemplary embodiments, the gaps 200 and 208 are formed in the stairway 55 and the handrail 77 linking the second storey (the floor board 22) with the third storey (the floor board 23), and the shutters 110 are structured so as to laterally divide the stairway, but this is not limiting. The gaps 200 and 208 may be formed in the stairway 50 and handrail 70 linking other storeys (for example, the stairway 50 linking the third storey with the fourth storey), and the shutters 110 structured so as to laterally divide this stairway 50. Further, the shutter device 100 may be provided at plural levels.

As a further example, in the above exemplary embodiments, the present invention is applied to the stairway 55 provided in the shaft space 12 that extends in the vertical direction of the building 10, but this is not limiting. The present invention may be applied to a flight of steps provided in other locations.

It will also be clear that numerous modes may be embodied within a scope not departing from the spirit of the present invention.

What is claimed is:

1. A building comprising:

a shutter that opens and closes in a horizontal direction;

a stairway in which a gap through which the shutter can pass is formed; and a handrail disposed at the stairway, the handrail including:

a handrail main body, in which a gap through which the shutter can pass is formed, and a movable member that closes the gap in the handrail main body, a connection member that connects one end portion of the movable member with the handrail main body, the movable body being turnable relative to the handrail main body, and a connection apparatus that releasably connects another end portion of the movable member with the handle main body.

2. The building according to claim 1, wherein the shutter includes at least one of a fire protection function or a smoke protection function, and wherein, in the event that a fire is detected, the shutter automatically closes and the connection of the other end portion of the movable member with the handrail main body by the connection apparatus is automatically released.

3. The building according to claim 2, wherein the stairway is disposed in a shaft space, and the shaft space is partitioned into upper and lower portions by the shutter being closed.

4. The building according to claim 1, wherein the stairway is disposed in a shaft space, and the shaft space is partitioned into upper and lower portions by the shutter being closed.

* * * * *